US007546809B2

(12) United States Patent
Chen

(10) Patent No.: US 7,546,809 B2
(45) Date of Patent: Jun. 16, 2009

(54) SAFETY ASSEMBLY FOR AN INVERSION TABLE

(75) Inventor: Shi-Lin Chen, Taichung Hsien (TW)

(73) Assignee: Lifegear Taiwan Ltd., Daya Hsiang, Taichung Hsien (TW)

( * ) Notice: Subject to any disclaimer, the term of this patent is extended or adjusted under 35 U.S.C. 154(b) by 246 days.

(21) Appl. No.: 11/737,691

(22) Filed: Apr. 19, 2007

(65) Prior Publication Data

US 2008/0261791 A1 Oct. 23, 2008

(51) Int. Cl.
*A47F 5/12* (2006.01)

(52) U.S. Cl. ..... 108/6; 16/324; 108/1; 482/144

(58) Field of Classification Search ..... 16/319, 16/322, 324, 325, 326, 334, 337; 5/610; 482/143, 144, 145; 403/109.3, 328, 348, 403/359.4; 606/244; 248/222.11, 222.14, 248/222.52; 108/6, 13
See application file for complete search history.

(56) References Cited

U.S. PATENT DOCUMENTS 4,583,731 A * 4/1986 Crivello et al. ..... 482/138
5,967,956 A * 10/1999 Teeter ..... 482/144
2007/0003361 A1 * 1/2007 Wang ..... 403/109.3

* cited by examiner

*Primary Examiner*—Lynda Jasmin
*Assistant Examiner*—Michael Lee
(74) *Attorney, Agent, or Firm*—patenttm.us

(57) ABSTRACT

A safety assembly for an inversion table having a mounting bracket and a table connected pivotally to the mounting bracket with two pivot posts has a mounting jacket, an operating head and a fastening element. The mounting jacket is connected securely to the mounting bracket and has a mounting panel, an opening and an engaging sheet. The operating head is attached rotatably to the mounting jacket and as a connecting tube and a rotating plate. The fastening element is connected to the operating head in the mounting jacket and has a fastener, a washer and a spring.

4 Claims, 6 Drawing Sheets

SAFETY ASSEMBLY FOR AN INVERSION TABLE

BACKGROUND OF THE INVENTION

1. Field of the Invention

The present invention relates to a safety assembly, and more particularly to a safety assembly for an inversion table, which can be adjusted easily and safely.

2. Description of Related Art

With reference to FIG. 6, a conventional inversion table holds a person's body to relax or relieve back pain, and has a mounting bracket (60), a table (61) and an ankle clamp assembly.

The mounting bracket (60) has two top ends and two mounting seats (601). The mounting seats (601) are respectively mounted on the top ends of the mounting bracket (60) and each mounting seat (601) has a mounting hole. The table (61) is attached pivotally between the mounting seats (601) of the mounting bracket (60), holds a person's body before the table (61) is inverted and has a bottom end, two sidewalls and two extension beams (611). The extension beams (611) are respectively connected securely to the table (61) and each extension beam (611) has a proximal end, a distal end, a pivot post (612) and a connecting plate (613). The proximal ends of the extension beams (611) are connected securely to the sidewalls of the table (61). The distal ends of the extension beams (611) are aligned with the mounting holes in the mounting seats (601) of the mounting bracket (60). The pivot posts (612) are respectively formed perpendicularly from the distal ends of the extension beams (611) and are attached rotatably into the mounting holes in the mounting seats (601) of the mounting bracket (60). The connecting plates (613) are respectively connected to the mounting seats (601) with bolts and mounted around the pivot posts (612) near the mounting holes to prevent the pivot posts (612) detaching from the mounting seats (601) of the mounting bracket (60). The ankle clamp assembly is connected to the bottom end of the table (61) and clamps and holds a person's ankles when the table (61) is pivoted to an inverted position.

However, the conventional inversion table has some shortcomings.

1. The connecting plates (613) of the table (61) easily loosen after a long time of use. Then, the pivot posts (612) may depart from the mounting holes in the mounting seats (601) of the mounting bracket (60) and this will influence the safety of using the conventional inversion table.

2. In addition, tools, such as screwdrivers or wrenches are necessary for fastening or loosening the bolts between the mounting seats (601) and the connecting plates (613), and to assemble the table (61) with the mounting bracket (60) of the conventional inversion table is time-consuming and troublesome.

The invention provides a safety assembly for an inversion table that mitigates or obviates the aforementioned problems.

SUMMARY OF THE INVENTION

The main objective of the present invention is to provide a safety assembly for an inversion table that can be adjusted easily and safely.

The safety assembly for an inversion table having a mounting bracket and a table connected pivotally to the mounting bracket with two pivot posts comprises a mounting jacket, an operating head and a fastening element. The mounting jacket is connected and secured to the mounting bracket and has a mounting panel, an opening and an engaging sheet. The operating head is attached rotatably to the mounting jacket and has a connecting tube and a rotating plate. The fastening element is connected to the operating head in the mounting jacket and has a fastener, a washer and a spring.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
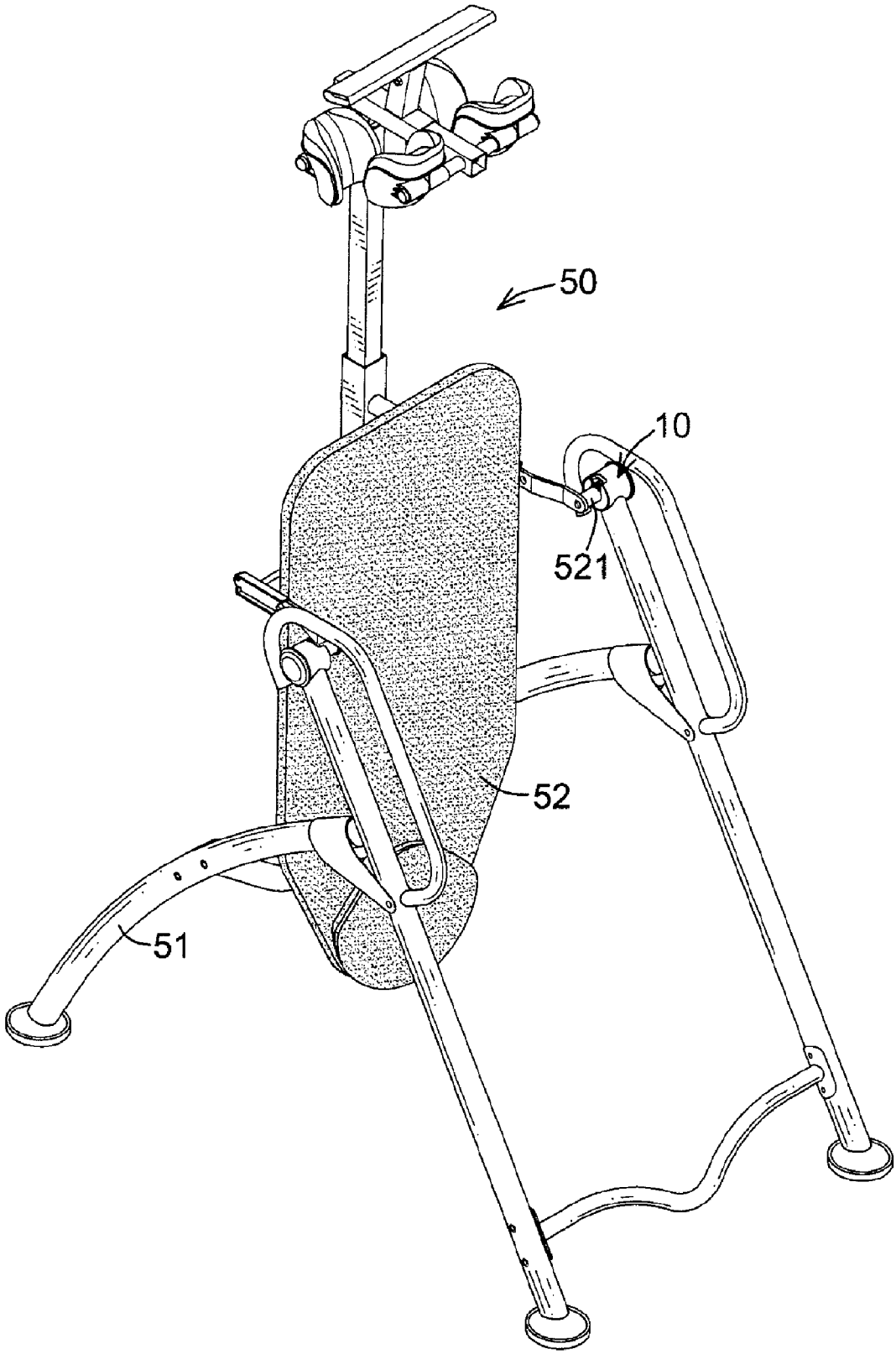
FIG. 1 is a perspective view of an inversion table with a safety assembly in accordance with the present invention.
Figure 2:
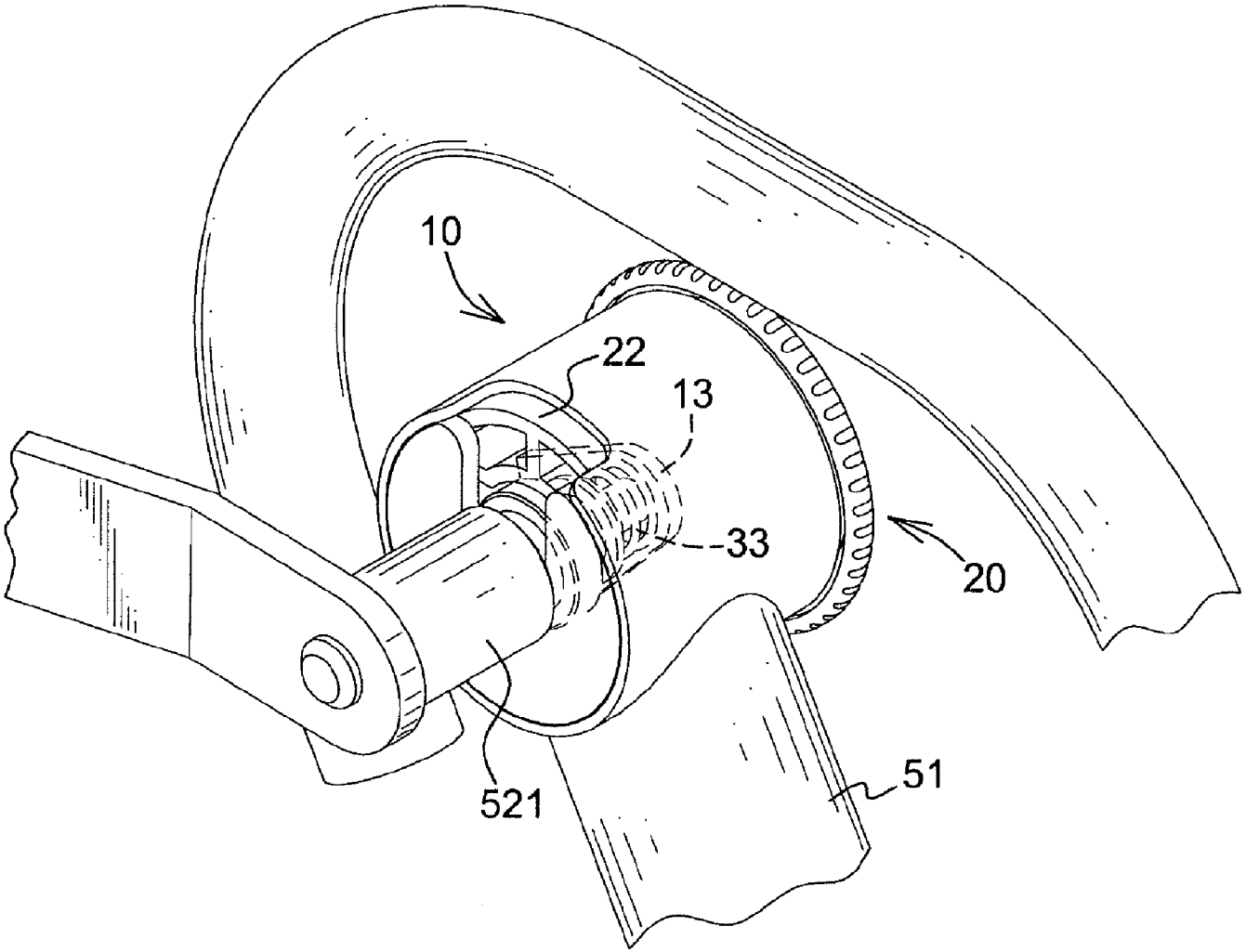
FIG. 2 is an enlarged perspective view of the safety assembly in FIG. 1.
Figure 3:
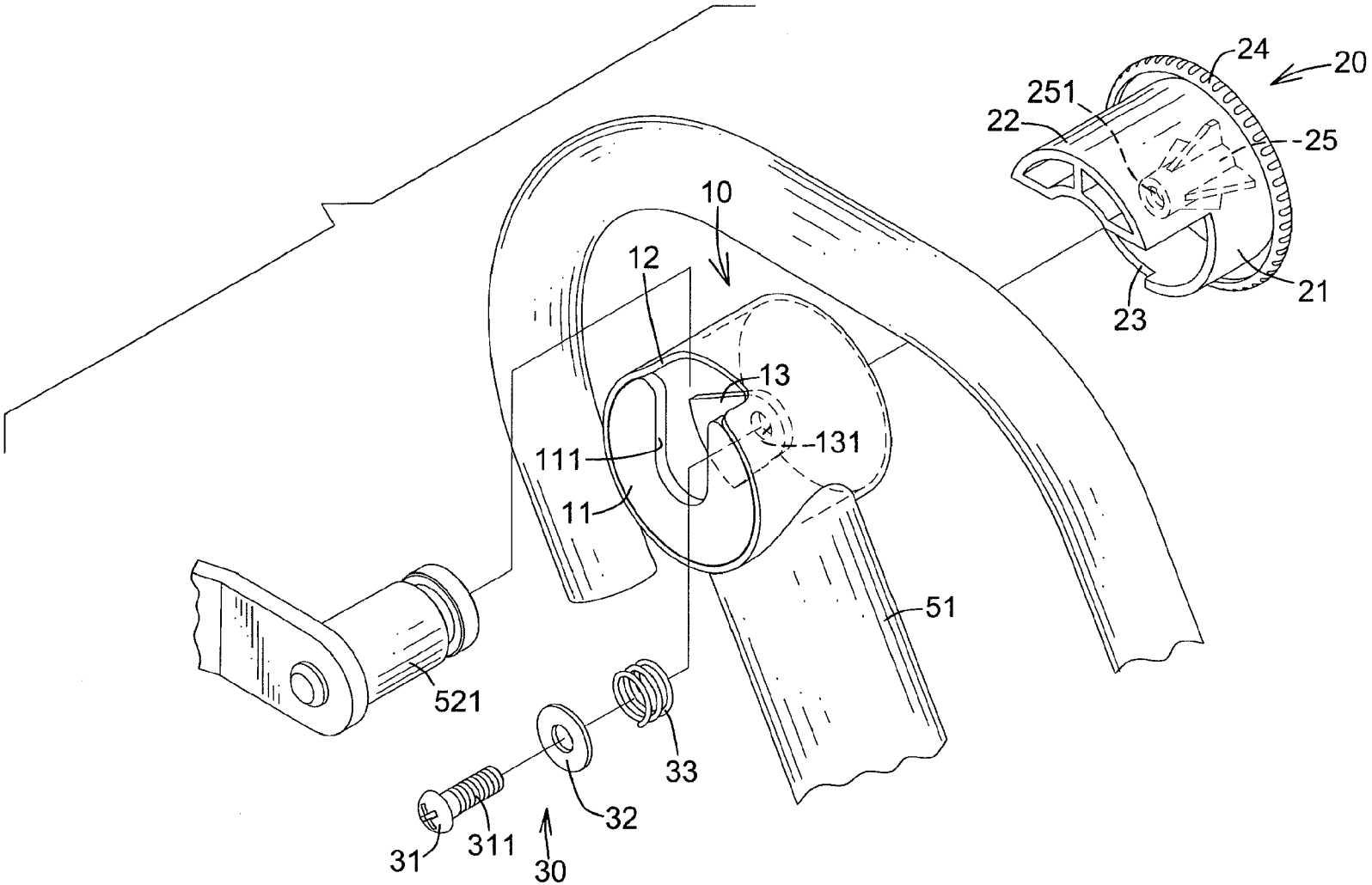
FIG. 3 is an enlarged exploded perspective view of the safety assembly in FIG. 1.

With reference to FIGS. 1 to 4, a safety assembly for an inversion table (50) having a mounting bracket (51) with two top ends and a table (52) connected pivotally to the mounting bracket (51) with two pivot posts (521), and comprises a mounting jacket (10), an operating head (20) and a fastening element (30).

The mounting jacket (10) is hollow, is connected securely to one of the top ends of the mounting bracket (51) of the inversion table (50) and has an inner end, an outer end, an internal surface, a chamber, a mounting panel (11), an opening (12) and an engaging sheet (13).

The inner end of the mounting jacket (10) is aligned with one of the pivot posts (521) of the table (52).

The mounting panel (11) is connected securely to the inner end of the mounting jacket (10) and has a mounting hole (111). The mounting hole (111) is formed through the mounting panel (11), communicates with the chamber of the mounting jacket (10) and is connected to the corresponding pivot post (521) of the table (52).

The opening (12) is formed through the mounting jacket (10) in the inner end and communicates with the mounting hole (111) in the mounting panel (11).

The engaging sheet (13) is formed in the chamber of the mounting jacket (10) with an angle to the opening (12), and has a proximal end, a distal end and a through hole (131). The proximal end of the engaging sheet (13) is formed securely to the internal surface of the mounting jacket (10). The through hole (131) is formed through the distal end of the engaging sheet (13).

The operating head (20) is attached rotatably to the mounting jacket (10) and has an inner end, an outer end, a connecting tube (21) and a rotating plate (24).

The connecting tube (21) is defined in the inner end of the operating head (20), is mounted with the mounting jacket (10) in the outer end and has a front end, a rear end, an extension covering (22) and an engaging recess (23).

The front end of the connecting tube (21) extends into the chamber of the mounting jacket (10) from the outer end.

The extension covering (22) is curved, is formed axially on the front end of the connecting tube (21) and extends into the opening (12) of the mounting jacket (10) over the engaging sheet (13). The corresponding pivot post (521) of the table (52) is mounted with the mounting jacket (10) and the operating head (20).

The engaging recess (23) is formed in the front end of the connecting tube (21) below the extension covering (22) and is aligned with the engaging sheet (13). When the engaging recess (23) engages with the engaging sheet (13), the operating head (20) cannot rotate relative to the mounting jacket (10). In other words, the operating head (20) can be rotated relative to the mounting jacket (10) when the engaging recess (23) don't engage with the engaging sheet (13).

The rotating plate (24) is mounted in the outer end of the operating head (20), is connected to the rear end of the connecting tube (21) and abuts against the outer end of the mounting jacket (10). The rotating plate (24) has a center, an internal surface and an attaching pipe (25). The attaching pipe (25) is formed on the center of the rotating plate (24) on the internal surface, is aligned with the distal end of the engaging sheet (13) and has an attaching hole and an inner thread (251). The attaching hole is formed in the attaching pipe (25) and is aligned with the through hole (131) in the engaging sheet (13). The inner thread is respectively formed in the attaching pipe (25).

The fastening element (30) is respectively connected to the operating head (20) in the mounting jacket (10) and has a fastener (31), a washer (32) and a spring (33).

The fastener (31) extends through the through hole (131) in the engaging sheet (13), is connected to the attaching hole in the attaching pipes (25) and has an outer thread (311) screwed with the inner thread (251) of the attaching pipe (25). Then, the operating head (20) is connected to the mounting jacket (10) by the fastener (31).

The washer (32) is mounted around the fastener (31) between the engaging sheet (13) and the fastener (31).

The spring (33) is mounted around the fastener (31) and abuts against the washer (32) and the engaging sheet (13).

Figure 4:
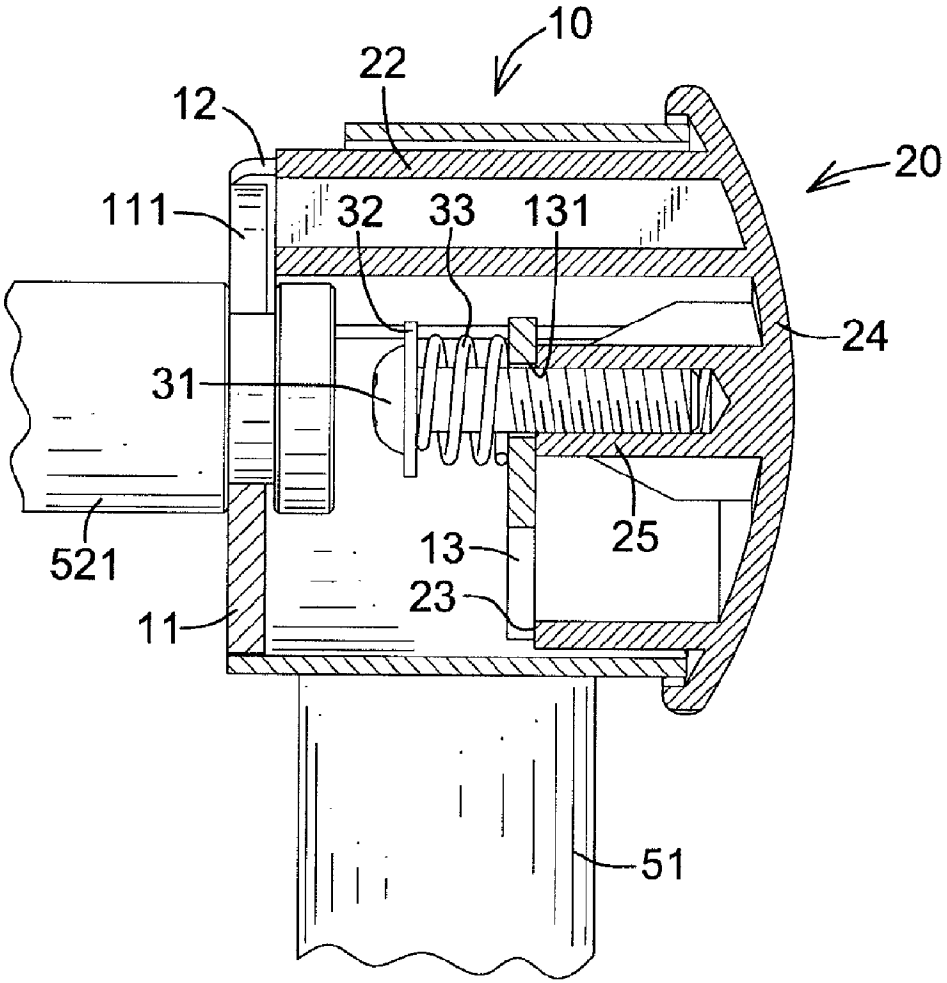
FIG. 4 is an enlarged side view in partial section of the safety assembly in FIG. 1.
Figure 5:
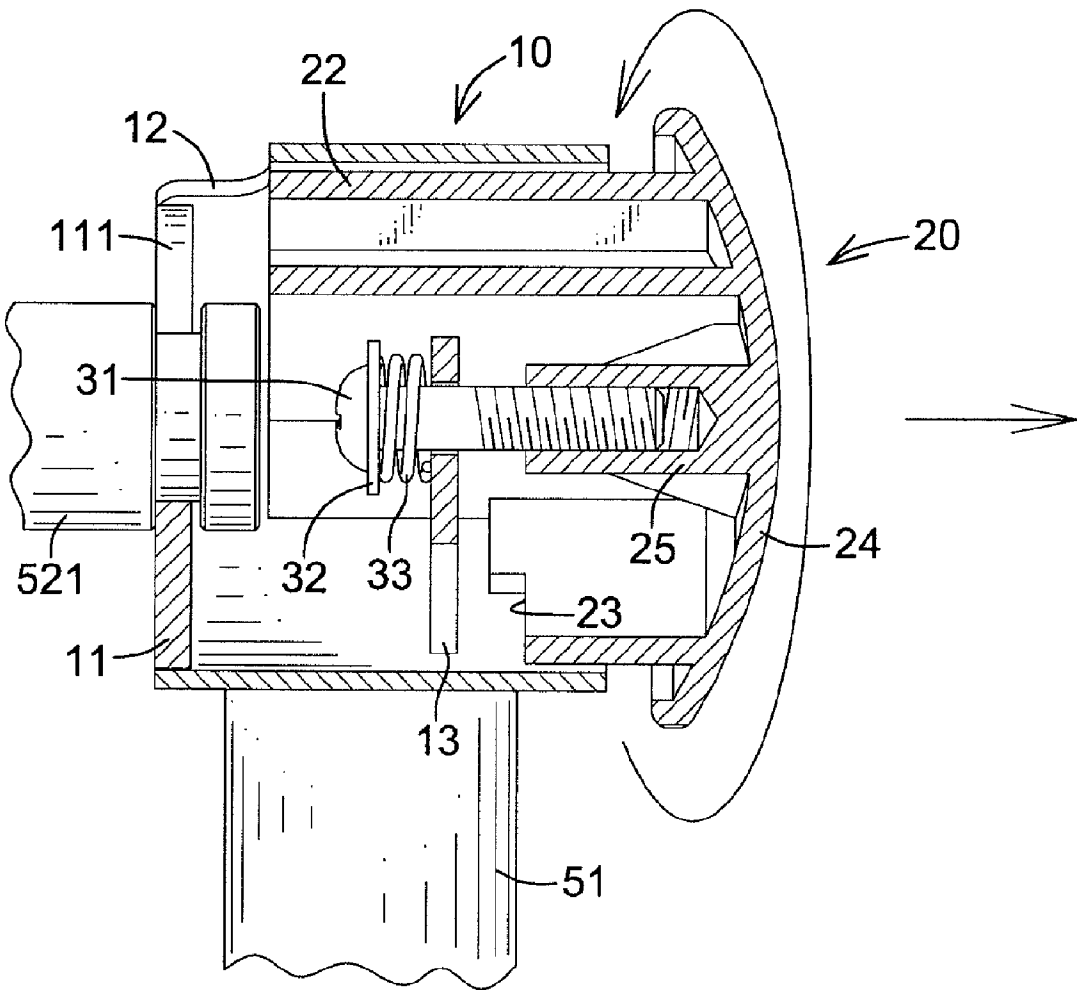
FIG. 5 is an enlarged operational side view in partial section of the safety assembly in FIG. 1.
Figure 6:
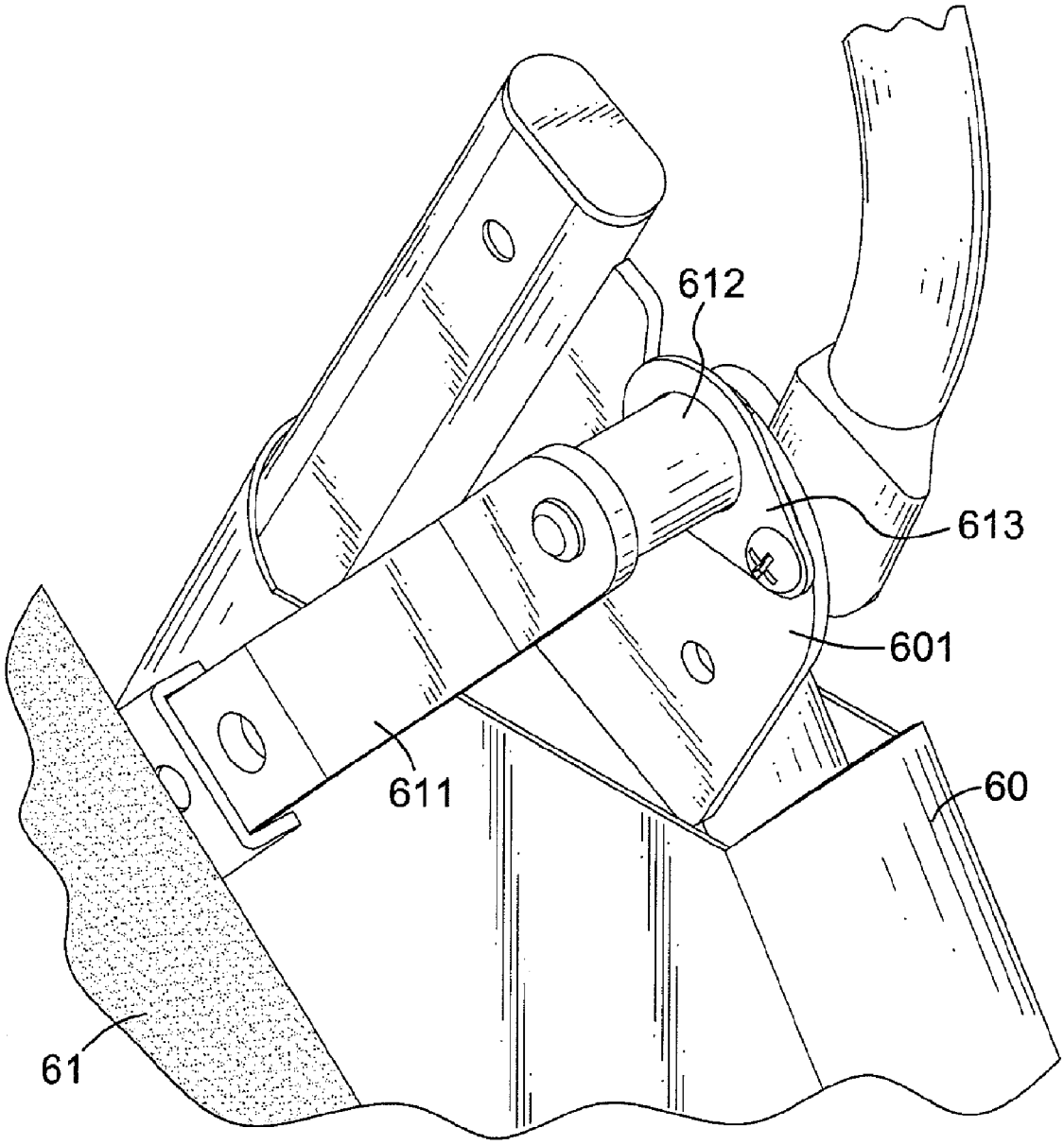
FIG. 6 PRIOR ART
FIG. 6 is an enlarged perspective view of a conventional inversion table in accordance with the prior art.

In practice, two safety assemblies are mounted on an inversion table (50). With reference to FIGS. 4 and 5, users can detach the table (52) from the mounting bracket (51) by pulling the operating heads (20) out the mounting jackets (10) so the engaging recesses (23) can be moved away from the engaging sheets (13) in the mounting jackets (10). Then, the operating heads (20) can be rotated relative to the mounting jackets (10), and the extension coverings (22) will rotate with the operating heads (20) relative to the openings (12). When the extension coverings (22) are rotated relative to the openings (12), the pivot posts (521) are released from the mounting holes (111) in the mounting panels (11) and the openings (12) so table (52) can be departed from the mounting bracket (51) easily and quickly.

In addition, the pivot posts (521) can be mounted securely in the mounting jackets (10) and the operating heads (20) with the springs (33) pushing the washers (32) and the fasteners (31) to make the pivot posts (521) being held between the mounting panels (11) and the extension coverings (22).

The safety assembly for an inversion table as described has the following advantages:

1. The pivot posts (521) of the table (52) can be held securely with the mounting bracket (51) between the mounting jackets (10) and the operating heads (20) by the engaging sheets (13), the engaging recesses (23) and the springs (33). Thus, the pivot posts (521) will not depart from the mounting bracket (51) and this can improve the safety of using the inversion table (50).

2. The table (52) can be assembled with or detached from the mounting bracket (51) easily and quickly by pulling and rotating the operating heads (20) relative to the mounting jackets (10) without using any tools, such as screwdrivers or wrenches to fasten or loosen the bolts.

Even though numerous characteristics and advantages of the present invention have been set forth in the foregoing description, together with details of the structure and features of the invention, the disclosure is illustrative only. Changes nay be made in the details, especially in matters of shape, size, and arrangement of parts within the principles of the invention to the full extent indicated by the broad general meaning of the terms in which the appended claims are expressed.

What is claimed is:

1. A safety assembly for an inversion table having a mounting bracket with two top ends and a table connected pivotally to the mounting bracket with two pivot posts, and the safety assembly comprising:

a mounting jacket being hollow, being adapted to connect securely to one of the top ends of the mounting bracket and having an inner end being adapted to align with a corresponding pivot post of the table;

an outer end;

an internal surface;

a chamber;

a mounting panel being connected securely to the inner end of the mounting jacket and having a mounting hole being formed through the mounting panel and communicating with the chamber of the mounting jacket, being adapted to connect to the corresponding pivot post of the table;

an opening being formed radially through the mounting jacket in the inner end, and communicating with the mounting hole in the mounting panel; and an engaging sheet being formed in the chamber of the mounting jacket with an angle to the opening and having a proximal end being formed securely to the internal surface of the mounting jacket; and a distal end;

an operating head being attached rotatably to the mounting jacket and having an inner end;

an outer end;

a connecting tube being mounted in the inner end of the operating head, being mounted with the mounting jacket in the outer end and having a front end extending into the chamber of the mounting jacket from the outer end;

a rear end;

an extension covering being curved, being formed axially on the front end of the connecting tube and extending into the opening of the mounting jacket over the engaging sheet; and an engaging recess being formed in the front end of the connecting tube below the extension covering, being aligned with the engaging sheet and selectively engaging with the engaging sheet; and a rotating plate being mounted in the outer end of the operating head, connected to the rear end of the connecting tube, abutting against the outer end of the mounting jacket and having a center;

an internal surface; and an attaching pipe being formed on the center of the rotating plate on the internal surface, being aligned with the distal end of the engaging sheet and having an attaching hole; and a fastening element being connected to the operating head in the mounting jacket and having a fastener extending through the through hole in the engaging sheet, being connected to the attaching hole in the attaching pipe and having a washer being mounted around the fastener between the engaging sheet and the fastener; and a spring being mounted around the fastener and abutting against the washer and the engaging sheet.

2. The safety assembly for an inversion table as claimed in claim 1, wherein the engaging sheet has a through hole being formed through the distal end and aligned with the attaching hole in the attaching pipe.

3. The safety assembly for an inversion table as claimed in claim 2, wherein the attaching pipe has an inner thread; and the fastener has an outer thread being screwed with the inner thread of the attaching pipe.

4. The safety assembly for an inversion table as claimed in claim 1, wherein the attaching pipe has an inner thread; and the fastener has an outer thread being screwed with the inner thread of the attaching pipe.

* * * * *